US005839599A

United States Patent [19]

Lin

[11] Patent Number: 5,839,599

[45] Date of Patent: Nov. 24, 1998

[54] STRUCTURE OF CUP

[76] Inventor: Jung Chuang Lin, P.O. Box 82-144, Taipei, Taiwan

[21] Appl. No.: 741,558

[22] Filed: Oct. 31, 1996

[51] Int. Cl.[6] ..... B65D 8/06

[52] U.S. Cl. ..... 220/410; 220/435; 220/420; 220/703

[58] Field of Search ..... 220/435, 437, 220/439, 410, 408, 420, 425, 703, 464, 468, 469, 23.83, 23.86, 506, 662; 215/10, 12.1, 13.1

[56] References Cited

U.S. PATENT DOCUMENTS

| | | | |
|---|---|---|---|
| 1,057,893 | 4/1913 | Steel | 220/410 |
| 1,075,834 | 10/1913 | Saint Vrain Le Sieur | 220/425 |
| 2,194,719 | 3/1940 | Parrish | 220/437 |
| 2,630,938 | 3/1953 | Burnett | 220/410 |
| 2,632,576 | 3/1953 | Hassid et al. | 220/410 |
| 2,782,956 | 2/1957 | Richman | 220/464 |
| 3,339,794 | 9/1967 | Oberländer et al. | 220/468 |
| 3,971,360 | 7/1976 | Spoeth, Jr. | 220/408 |
| 4,789,073 | 12/1988 | Fine | 220/410 |
| 5,040,317 | 8/1991 | Kadjevich | 220/410 |
| 5,553,735 | 9/1996 | Kimura | 220/410 |

*Primary Examiner*—Stephen J. Castellano

[57] ABSTRACT

A cup including a transparent cup shell internally transfer-printed with a design, a cup body externally transfer-printed with a design and mounted within the cup shell and having a bottom coupling projection inserted through a center bottom hole at the bottom wall of the cup shell, and a cap fastened to the coupling projection of the cup body and disposed in a bottom chamber below the bottom wall of the cup shell for permitting the cup body to be turned in the center through hole of the bottom wall of the cup shell.

4 Claims, 6 Drawing Sheets

STRUCTURE OF CUP

BACKGROUND OF THE INVENTION

1. Field of the Invention

This invention relates to cups, and relates more particularly to such a cup which is comprised of a transparent cup shell, and a cup body revolvably mounted within the cup shell. When the cup body is turned relative to the cup shell, the design of the cup body is moved relative to the design of the cup shell, and therefore an animated picture is shown.

2. Description of the Prior Art

A conventional cup for drinking purposes generally comprises a bowl-like cup body with a handle. The cup body may have a design transfer-printed on the outside wall. However, because the design is transfer-printed on the outside wall of the cup body, it fades soon. FIG. 7 shows another structure of cup according to the prior art which is comprised of a top-flanged, cylindrical cup body, and a plurality of decorative rings mounted around the cup body and arranged in a stack. The decorative rings are peripherally transfer-printed with a respective design, and can be turned relative to one another. When the decorative rings are turned relative to one another, the pattern which is formed of the designs of the decorative rings is relatively changed. However, this structure of cup still cannot eliminate the designs of the decorative rings from fading.

SUMMARY OF THE INVENTION

This invention relates to cups, and relates more particularly to such a cup which is comprised of a transparent cup shell, and a cup body revolvably mounted within the cup shell. When the cup body is turned relative to the cup shell, the design of the cup body is moved relative to the design of the cup shell, and therefore an animated picture is shown.

The cup according to the present invention is comprised of a transparent cup shell, and a cup body secured to a bottom center hole of the cup shell by a cap and turned therein. The cup shell has a design on the inside wall. The cup body has a design on the outside wall. When the cup shell and the cup body are fastened together, the designs of the cup body and cup shell are protected on the inside. When the cup body is turned relative to the cup shell, the design of the cup body is moved relative to the design of the cup shell, and therefore an animated picture is shown. According to another embodiment of the present invention, ornaments may be installed in between the cup shell and the cup body.

DETAILED DESCRIPTION OF THE PREFERRED EMBODIMENT

Figure 1:
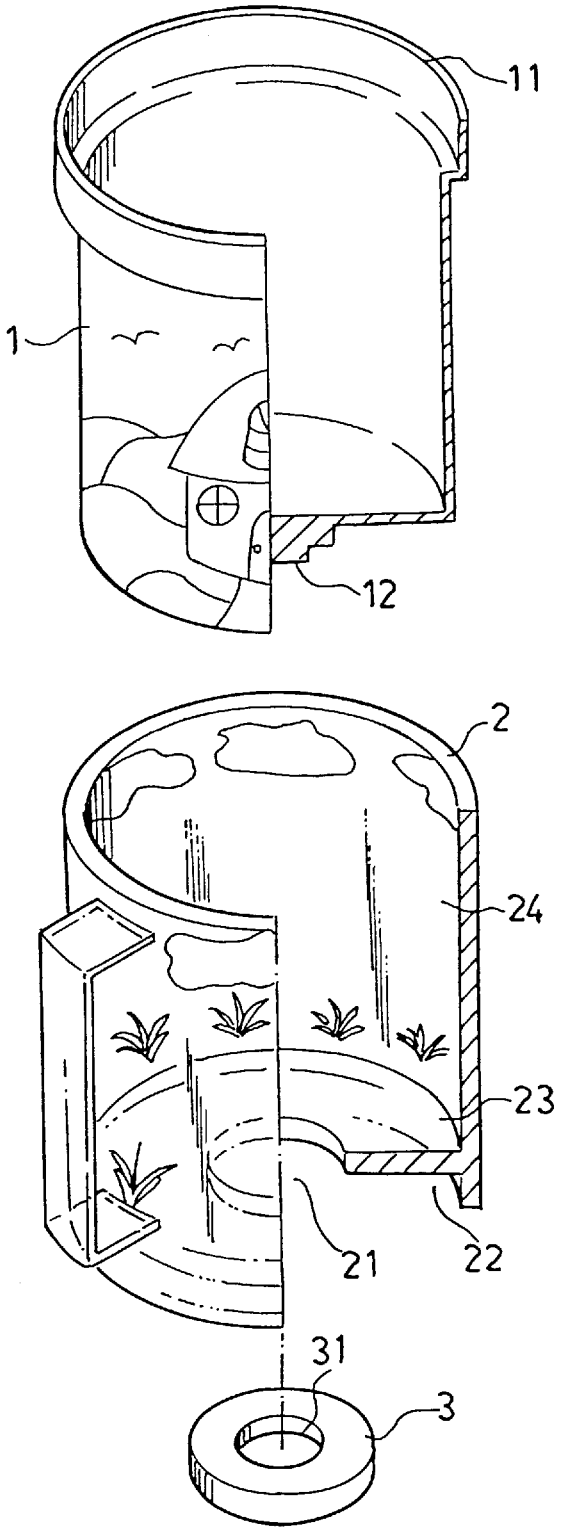
FIG. 1 is an exploded view of a cup according to a first embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
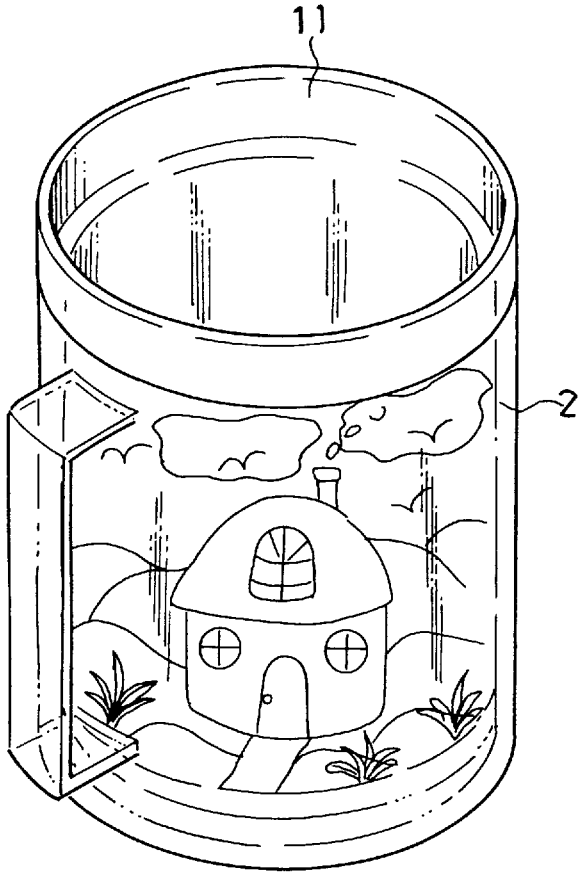
FIG. 2 is an elevational view of the cup of the first embodiment of the present invention.

Referring to FIGS. 1 and 2, a cup in accordance with the present invention is comprised of a bowl-like cup body 1, a bowl-like cup shell 2, and a circular cap 3. The cup body 1 comprises a top flange 11 perpendicularly raised from the periphery of the top open side thereof and then turned upwards, and a stepped, cylindrical bottom coupling projection 12 downwardly raised from the center of the bottom close side thereof. The cup shell 2 is made from transparent material, having a bottom wall 23 defining a top receiving chamber 24 and a bottom chamber 22, and a circular center through hole 21 through the center of the bottom wall 23. Further, the cup shell 2 may be equipped with a handle or integrally made with a hand-hold portion for holding by hand. The circular cap 3 has a circular recessed hole 31 at one side.

Figure 3:
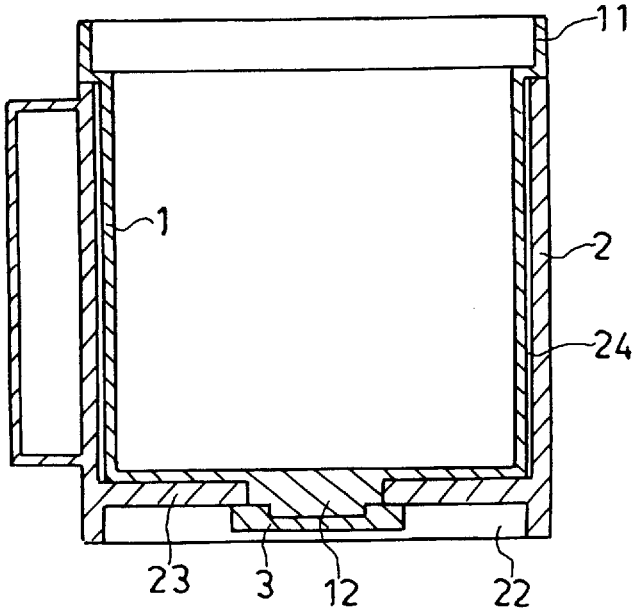
FIG. 3 is a sectional view of the cup of the first embodiment of the present invention.

Referring to FIG. 3 and FIG. 2 again, cup body 1 is mounted within the top receiving chamber 24 of the cup shell 2, permitting the coupling projection 12 to be inserted through the center through hole 21 of the bottom wall 23 of the cup shell 2 and the top flange 11 of the cup body 1 stopped above the topmost edge of the cup shell 2, then the circular cap 3 is attached to the coupling projection 12 by press-fitting the coupling projection 12 of the cup body 1 into the circular recessed hole 31 of the circular cap 3, and then the coupling projection 12 and the circular cap 3 are sealed together by a high-frequency sealing apparatus. When the circular cap 3 and the coupling projection 12 are sealed together, the cup body 1 can be turned in the center through hole 21 of the bottom wall 23 of the cup shell 2. Further, the outside wall of the cup body 1 and the inside wall of the cup shell 2 are transfer-printed with a respective design. When the cup body 1 is turned relative to the cup shell 2, the designs of the cup body 1 and cup shell 2 are moved relative to each other, thereby causing an animated picture to be shown.

Figure 4:
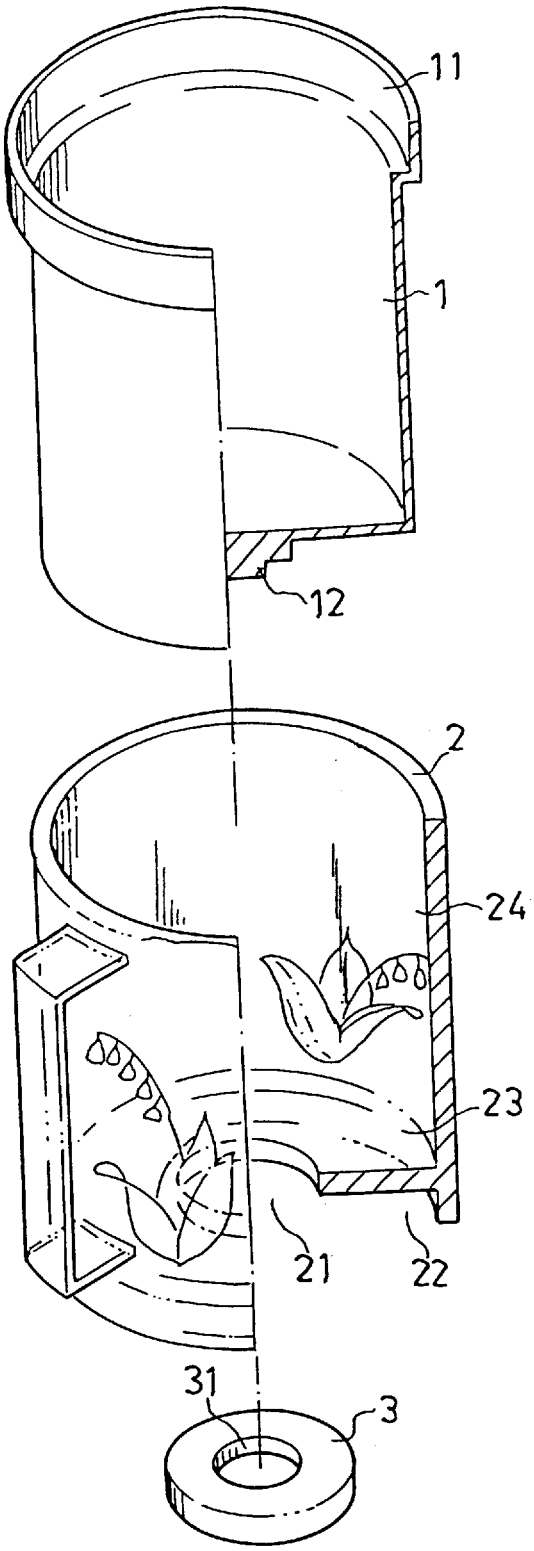
FIG. 4 is an exploded view of a cup according to a second embodiment of the present invention.

FIG. 4 shows an alternate form of the present invention, in which the cup shell 2 has a design covered within an outer covering layer thereof. Therefore the design can be constantly maintained in contact.

Figure 5:
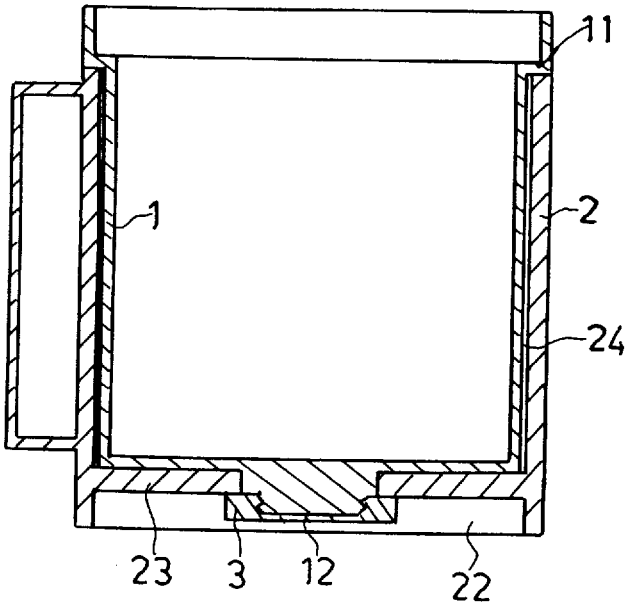
FIG. 5 is a sectional view of a cup according to a third embodiment of the present invention.

FIG. 5 shows another alternate form of the present invention, in which the circular cap 3 is fastened to the coupling projection 12 by a screw joint, and then sealed by a high frequency sealing apparatus.

Figure 6A:
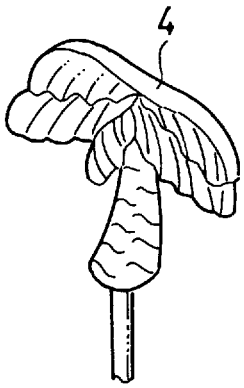
FIG. 6A is an elevational view of an ornament according to the present invention.
Figure 6:
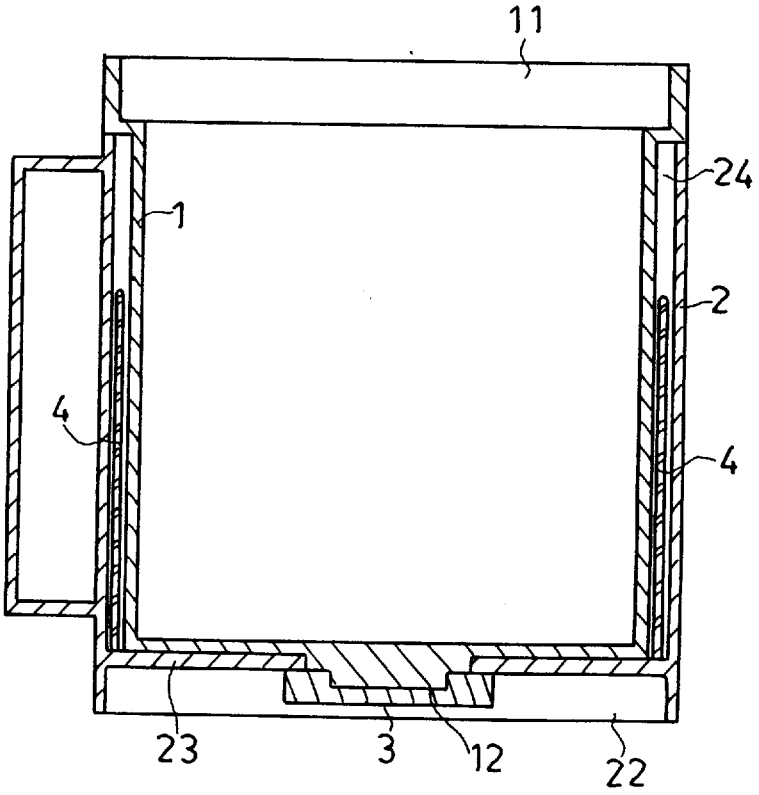
FIG. 6 is a sectional view of a cup according to a fourth embodiment of the present invention.
Figure 7:
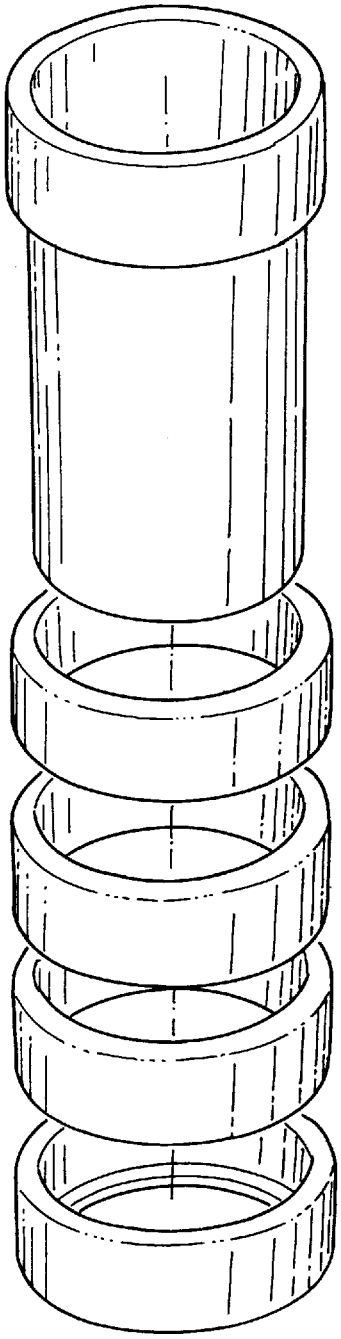
PRIOR ART FIG.7
FIG. 7 is an exploded view of a cup according to the prior art.

FIG. 6 shows still another alternate form of the present invention, in which a plurality of ornaments 4 are mounted within the space defined between the inside wall of the cup body 1 and the outside wall of the cup shell 2. The ornaments 4 may be variously shaped. FIG. 6A shows an example of the ornament.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A cup comprising:

a bowl-like cup shell made from transparent material, having a bottom wall defining a top receiving chamber and a bottom chamber, and a circular center through hole through the center of said bottom wall;

a bowl-like cup body mounted within the top receiving chamber of said cup shell, having a top flange raised around the periphery of a top open side thereof and stopped above said cup shell outside said top receiving chamber, and a stepped, cylindrical bottom coupling projection downwardly raised from a bottom close side thereof and inserted through the center through hole of the bottom wall of said cup shell; and a circular cap fastened to the bottom coupling projection of said cup body and disposed in the bottom chamber of said cup shell to secure said cup body to said cup shell, permitting said cup body to be turned in the center through hole of the bottom wall of said cup shell, said circular cap having a circular recessed hole at one side coupled to the bottom coupling projection of said cup body.

2. The cup as claimed in claim 1, wherein said circular cap is fastened to the bottom projection of said cup body by a screw joint.

3. The cup as claimed in claim 1, wherein said circular cap is fastened to the bottom projection of said cup body and sealed by a high frequency sealing apparatus.

4. The cup as claimed in claim 1, further comprising a plurality of ornaments mounted in an annular space defined between the inside of said cup shell and the outside of said cup body, and fixedly adhered to the bottom wall of said cup shell.

* * * * *